US005592797A

United States Patent [19]

Logan et al.

[11] Patent Number: 5,592,797

[45] Date of Patent: Jan. 14, 1997

[54] DECORATIVE MOLDING STRIP SYSTEM

[75] Inventors: Richard Logan, Kingsville, Canada; Charles E. Schiedegger, Metamora, Mich.; Michael C. Clark, Columbiaville, Mich.; Daniel G. Meyer, Rochester Hills, Mich.

[73] Assignee: Mid-America Building Products Corporation, Plymouth, Mich.

[21] Appl. No.: 310,432

[22] Filed: Sep. 22, 1994

Related U.S. Application Data

[63] Continuation-in-part of Ser. No. 143,253, Oct. 26, 1993, Pat. No. 5,457,923, which is a continuation-in-part of Ser. No. 916,399, Jul. 20, 1992, abandoned, and Ser. No. 158,163, Nov. 24, 1993, Pat. No. 5,398,469, which is a continuation-in-part of Ser. No. 143,253, Oct. 26, 1993, and Ser. No. 262,918, Jun. 20, 1994, abandoned.

[51] Int. Cl.[6] ..... F04F 19/04

[52] U.S. Cl. ..... 52/288.1; 52/287.1; 52/272; 52/257

[58] Field of Search ..... 52/287.1, 280, 52/288.1, 272, 254, 255, 257, 241, 716, 718.01

[56] References Cited

U.S. PATENT DOCUMENTS

| | | | |
|---|---|---|---|
| 417,949 | 12/1889 | Sagendorph | 52/287 |
| 1,229,765 | 6/1917 | Lehman | 52/287 |
| 2,114,044 | 4/1938 | Bonnell | 52/280 |
| 3,201,910 | 8/1965 | Keesee | 52/287 |
| 3,302,350 | 2/1967 | Brown | 52/287 |
| 3,464,177 | 9/1969 | Amato | 52/288 |
| 3,481,092 | 12/1969 | Constantino | 52/288 |
| 3,616,587 | 11/1971 | Schlafly | 52/288 |
| 4,091,586 | 5/1978 | Schwartz | 52/288 |
| 4,706,626 | 11/1987 | Rumsey | 52/255 X |
| 4,709,522 | 12/1987 | Carnahan | 52/287 |
| 4,843,771 | 7/1989 | Chapman et al. | 52/288.1 |
| 5,001,877 | 3/1991 | Edwards | 52/288 |
| 5,086,598 | 2/1992 | Weldy | 52/257 X |
| 5,273,258 | 12/1993 | Bedics | 52/288.1 X |

FOREIGN PATENT DOCUMENTS

| | | | |
|---|---|---|---|
| 7413048 | 4/1976 | Netherlands | 52/288 |
| 567798 | 8/1977 | U.S.S.R. | 52/288 |
| 2191518 | 12/1987 | United Kingdom | 52/288 |

*Primary Examiner*—Carl D. Friedman
*Assistant Examiner*—Winnie Yip
*Attorney, Agent, or Firm*—Barnes, Kisselle, Raisch, Choate, Whittemore & Hulbert, P.C.

[57] ABSTRACT

For use in a decorative molding system comprising thin flexible plastic molding strips having clips thereon and flexible tracks engaged by the clips, a plastic corner member provided between the adjacent plastic molding strips and forming a corner for receiving a pair of the plastic molding strips having free ends with their longitudinal axis forming an angle at a corner of a room. The plastic corner member comprises a one piece plastic body having side walls intersecting at substantially the same angle as the angle formed by the edges of said ends of adjacent plastic molding strips. Each wall has substantially the same undulating cross sectional configuration as the adjacent plastic molding strips. Each wall has an upper free edge, a lower free edge and a vertical free edge, an outer surface and an inner surface. A flexible plastic clip is attached to each the wall. Each clip has first end and a second free end. The first end is attached to its respective wall intermediate the upper free edge of the wall and the lower free edge of the wall and the second free end of the clip is attached to each the wall extending at an acute angle to the wall of the corner member from the point of attachment. Each free end of each clip on the wall of the corner member interengages the track and holds the corner member in contact with the adjacent molding strips.

9 Claims, 16 Drawing Sheets

45
48
5
30
35
31
32
46
51
50
49

31a
46a
48a
31a
32a
5

31a
49a
50a
48a
5
18,19
45a
32a 31a
49a
50a
5
50a
32a
48a 31a
49a
5
50a
32a
50a
48a

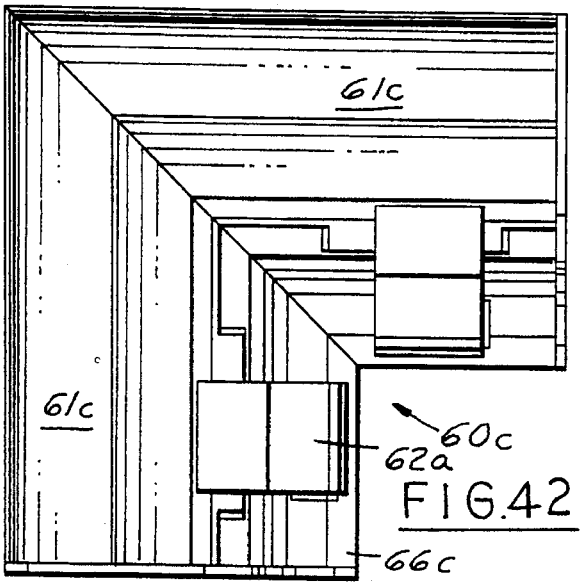
FIG.42
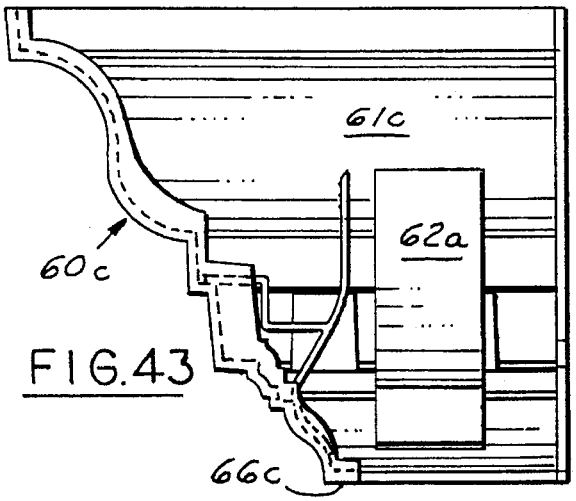
FIG.43
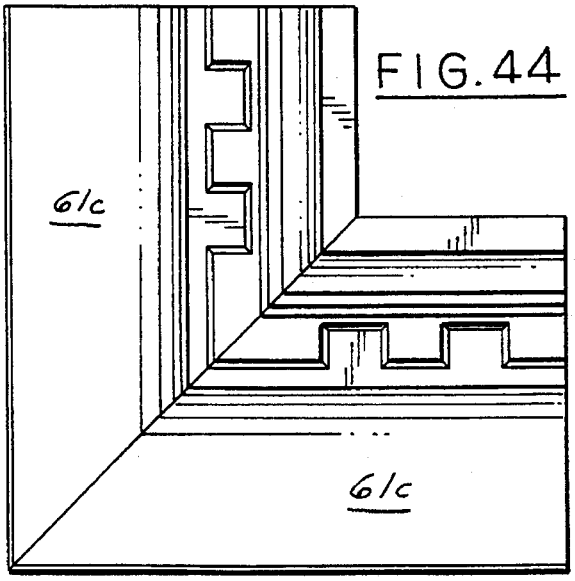
FIG.44
FIG.46
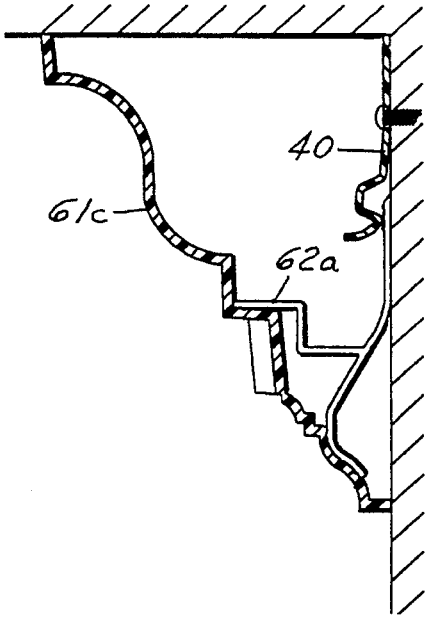
FIG.45
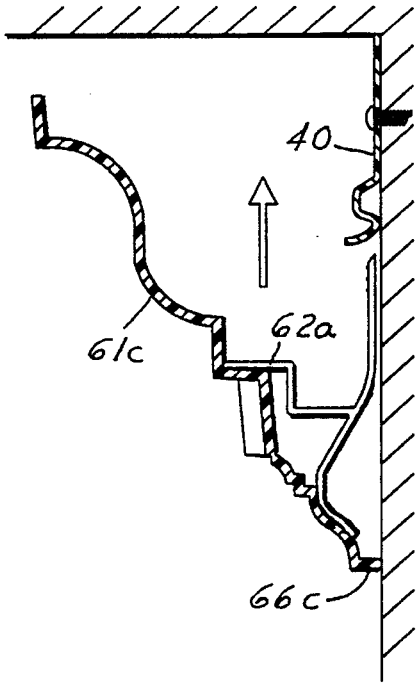

DECORATIVE MOLDING STRIP SYSTEM

This application is a continuation-in-part of U.S. patent applications Ser. No. 08/143,253 filed Oct. 26, 1993, now U.S. Pat. No. 5,457,923, which is a continuation-in-part of applications Ser. No. 07/916,399 filed Jul. 20, 1992, now abandoned, and Ser. No. 08/158,163 filed Nov. 24, 1993 now U.S. Pat. No. 5,398,469, which is a continuation-in-part of application Ser. No. 08/143,253 filed Oct. 26, 1993, and Ser. No. 08/262,918 filed Jun. 20, 1994, now abandoned.

BACKGROUND OF THE INVENTION

This invention relates to decorative molding installed at a corner formed by the juncture of a ceiling and a vertical wall. Particularly, this invention relates to systems for mounting the molding to the corner.

In the past, various moldings have been provided as disclosed and described, for example, in U.S. Pat. Nos. 3,302,350, 3,481,092 and 3,616,587. These patents disclose various methods of attaching the molding strip to the corner juncture. However, these methods are undesirable in that the mounting is permanent and/or rigid causing difficulties in modifying decorative features of a house in many applications. For, example, in many older homes the surface of the walls and ceilings are uneven due to settling of the house or water damage, for example. Firm and secure attachment of the prior art devices would be difficult due to the fact that the upper and lower surfaces of the molding are rigidly and/or permanently attached to the ceiling and wall. In Brown et al ('350) the walls of the mounting member are rigidly connected to the ceiling and wall by screws. The Constantino ('092) device is attached by applying adhesive to the flat upper and lower edges of the molding. In Schlafly, Jr. ('587) the upper and lower edges of the molding are rigidly attached to the walls by clips. Thus, it can be seen that the rigid mounting of these prior art devices do not allow the molding to conform or adjust to uneven wall surfaces.

In the aforementioned patent applications, there is disclosed a decorative molding strip wherein a thin molding strip of flexible plastic has an upper free edge, lower free edge, a front surface and a back surface. The upper free edge is adapted to lie against the ceiling and flex relative thereto. The lower free edge is adapted to lie against a vertical wall. A plurality of flexible plastic clips are fixed at space points along the thin molding strip along the back surface of the molding strip so that a first end of each clip is attached to the back surface of the molding strip and the free end engages of flexible plastic wall track.

In the aforementioned application Ser. No. 08/262,918 filed Jun. 20, 1994, at the juncture of adjacent molding strips, one of the molding strips is provided with a complementary shaped plastic segment spaced from the internal surface of the molding strip to provide a cavity. The other of the molding strips is provided with an axial plastic segment that has a projection of the same configuration adapted to extend into the cavity of an adjacent strip so that adjacent molding strips abut one another with the segment that extends into the cavity of an adjacent strip providing a bridge.

Among the objectives of the present invention are to provide such systems which utilizes novel outside and inside corner constructions; wherein the corners can be readily applied with minimum tools and skills; wherein the resultant system is aesthetically pleasing; wherein the corner construction will. accommodate variations in the angle of the walls and the ceilings to one another; and wherein the system is low in cost.

SUMMARY OF THE INVENTION

In accordance with the invention, the decorative molding system is of the type described in the aforementioned patent applications. A decorative molding system is removably installed at a ceiling and a vertical wall, said molding system comprising: a thin molding strip of flexible plastic having an upper free edge, a lower free edge, a front surface and a back surface, the upper free edge is adapted to lie against one of the ceiling and the vertical wall and flex relative thereto. The lower free edge is adapted to lie against the other of said ceiling and said vertical wall and flex relative thereto. A plurality of flexible plastic clips are provided. Each flexible plastic clip has a first end and a second free end. The flexible plastic clips are attached at spaced points along the back surface points of the molding strip such that the first end of each clip is attached on the back surface of said molding strip at a point of attachment intermediate the upper free edge and lower free edge of molding strip. Each clip is capable of flexing relative to the point of attachment to the molding. The molding strip is sufficiently flexible about its length as well as its width to provide conforming engagement of its upper free edge and its lower free edge with the ceiling and vertical wall. A wall track of flexible plastic has a back surface, a front surface, an upper edge and a forward leading edge providing a gap between the leading edge and the front surface. The track is mounted adjacent the upper edge of the track on one of the ceiling and said vertical wall such that the forward leading edge is spaced from the other of the ceiling and the vertical wall. The forward leading edge of said track is capable of flexing relative to the upper free edge of said track. Interengagement is provided on the second free end of the clip and the forward leading edge of said track such that when the thin molding strip with the flexible plastic clips attached thereto is mounted on the track by relative movement, the second free end of the clip is moved into the gap and the forward leading edge of the track is engaged. The thin molding strip is restrained against ready removal when said molding strip is mounted on said wall track, the clip being positioned between the lower forward free edge of the wall track and its associated wall to cause the forward leading edge to flex so that said clip is retained by a snap-fit and is removable while permitting the upper free edge and lower free edge of said molding strip to flex and conform with the ceiling and vertical wall. The system includes molded plastic corner members. Each corner comprises a body having thin integral walls configured to contact the front surfaces of the decorative molding strips that extend into the corners of the room. Each wall has a thin flexible plastic clip fixed to the back surface of the walls of the corner member. The flexible wall tracks that extend toward the corner of the room and the flexible clips on the walls of the corner member have free ends that engage the tracks. Each corner member preferably includes free edges that extends inwardly from each wall of the corner member and has a configuration conforming with the exterior of the respective molding strip and the ceiling and wall of the room. The free edges preferably have a width such that portions of the edges can be cut or sanded. Preferably, each track is configured to permit the such that a portion of the forward leading edge can be removed to provide a tighter fit with the wall or ceiling. The corner members are preferably injection molded.

DESCRIPTION OF THE DRAWINGS

FIG. 42 is a top plan view of an outside corner member.

FIG. 43 is a view of the corner member shown in FIG. 42 taken from the bottom.

FIG. 44 is a bottom view of the corner member shown in FIG. 42.

FIG. 45 is a sectional view showing the corner member during assembly on tracks.

FIG. 46 is a sectional view showing the corner member in assembled position.

DESCRIPTION OF A PREFERRED EMBODIMENTS

Figures 1, 2, 3, 4:
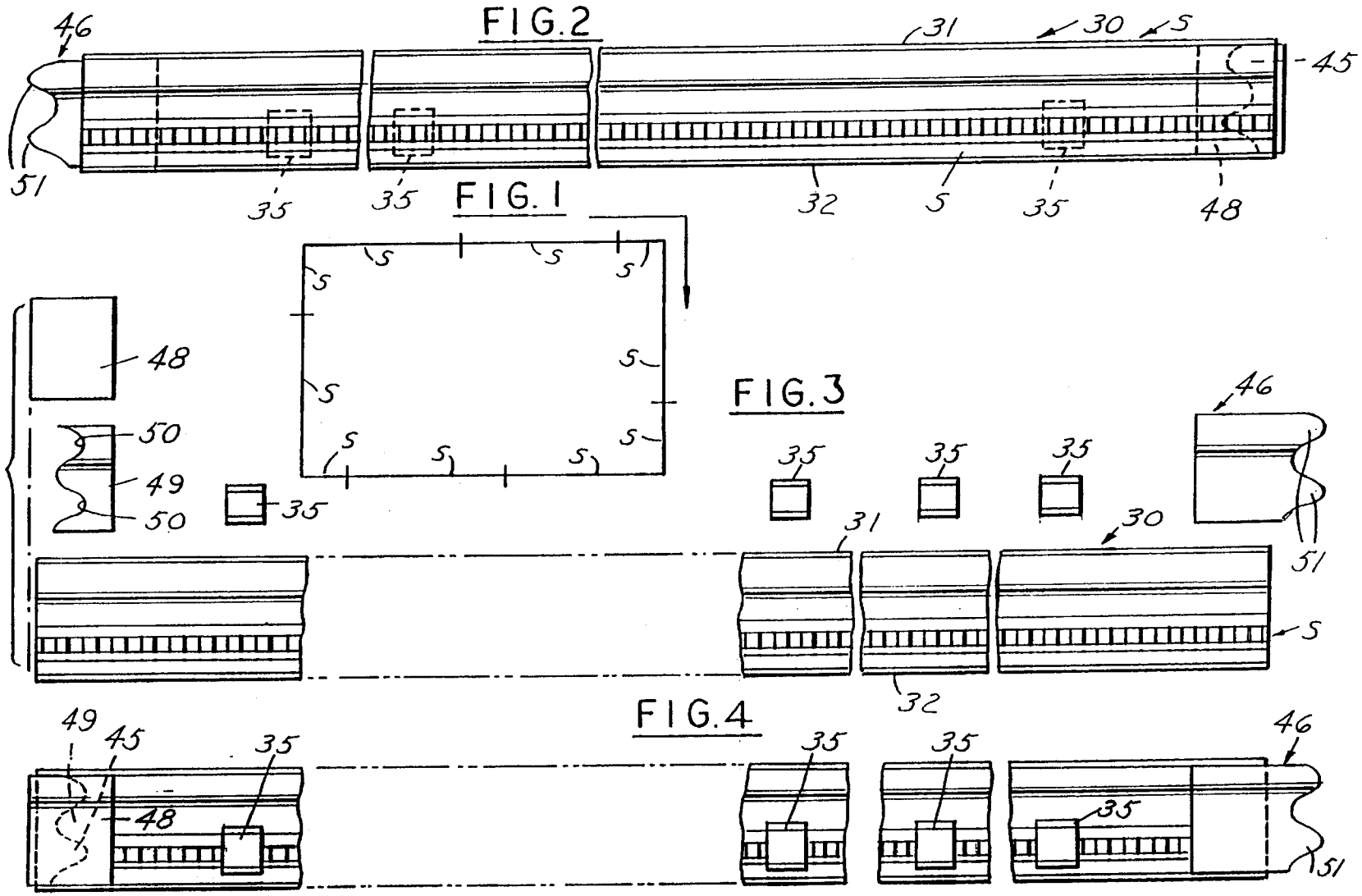
FIG. 1 is a plan diagram of a decorative plastic molding system for a room.
FIG. 2 is a fragmentary front elevational view of a decorative plastic molding strip embodying the invention.
FIG. 3 is a rear exploded view of the decorating strip shown in FIG. 2.
FIG. 4 is a rear assembled view of the strip shown in FIG. 2.

Referring to FIG. 1 which is a planned diagram of a molding system embodying the invention, it can be seen that a plurality of flexible molding strips S are provided about the periphery of the room in an abutting relationship.

In accordance with the invention, a joint is provided between the lengths of strip S along each wall. The joint at the corners is provided, for example, as shown in the aforementioned patent applications, incorporated herein by reference.

Referring to FIGS. 2–13, each strip S comprises a body 30 of flexible plastic material and is preferably formed by vacuum forming in order that the outer surface thereof will have a simulated grain formed in the mold to simulate wood. The strip is made of plastic material such as polystyrene that can be painted or stained as desired.

Figure 12:
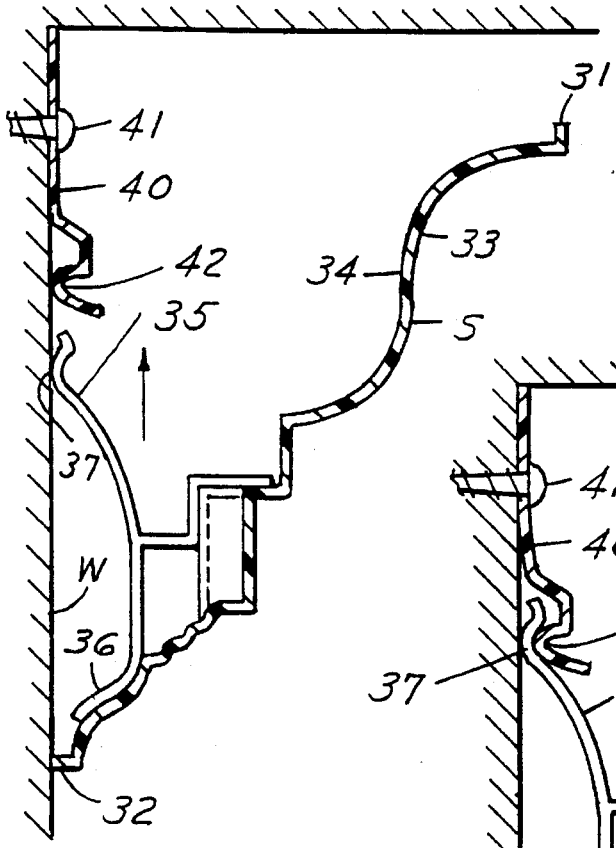
FIG. 12 is a fragmentary sectional view showing the decorative plastic strip being assembled on a track in a room.
Figure 13:
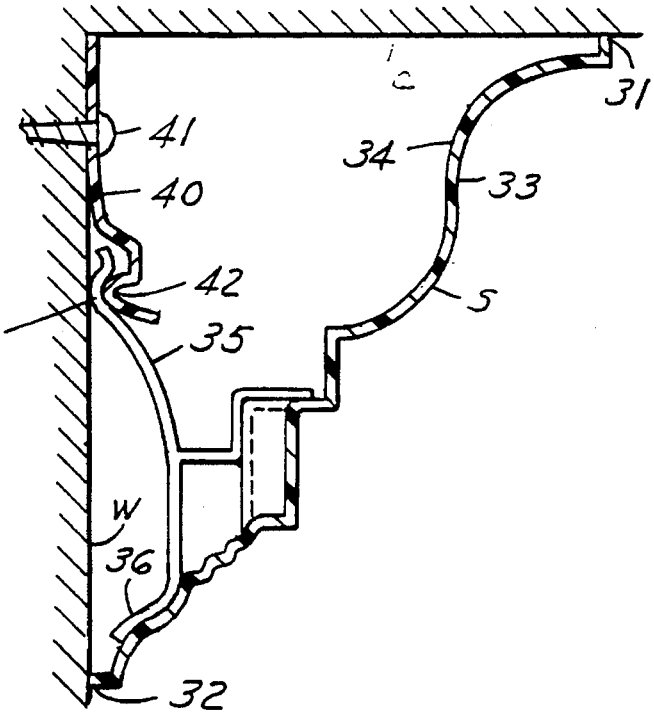
FIG. 13 is a sectional view similar to FIG. 12 showing the strip in assembled relationship to the track, wall and ceiling.
Figure 14:
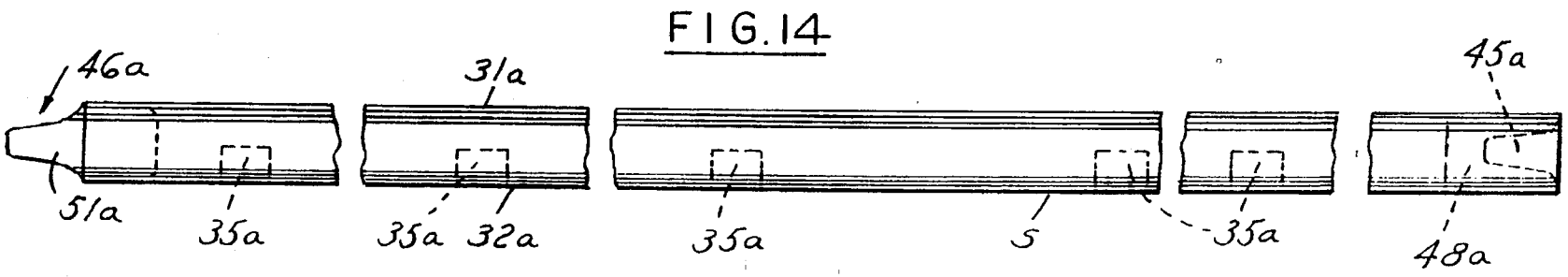
FIG. 14 is a fragmentary front elevational view of a modified form of strip.
Figure 15:
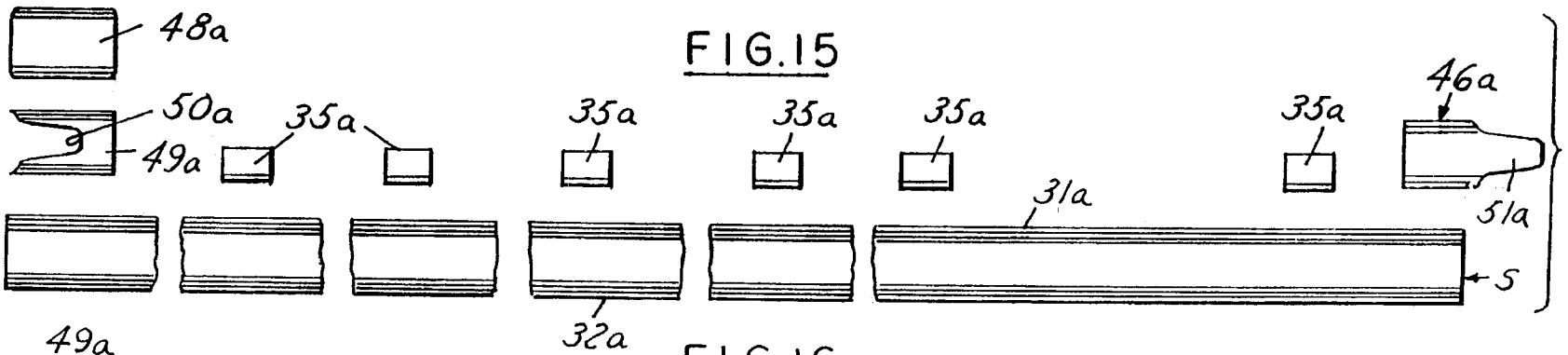
FIG. 15 is a rear exploded view of the strip shown in FIG. 14.
Figure 16:
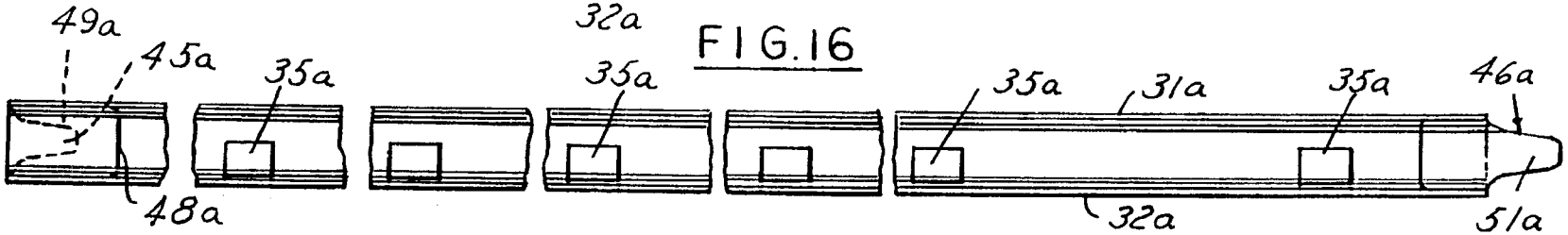
FIG. 16 is an assembled rear view of the strip shown in FIG. 14.
Figures 17, 18, 19:
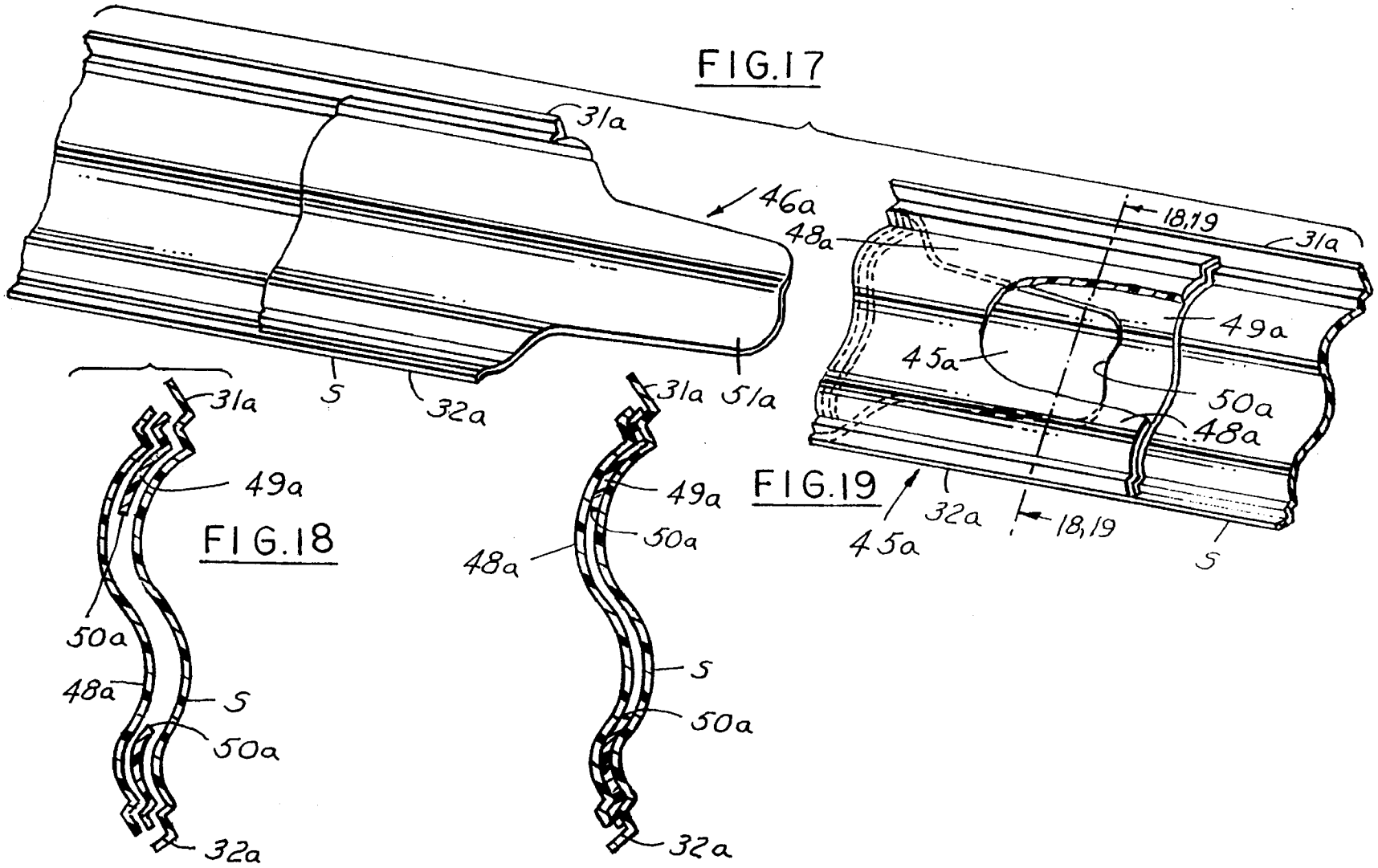
FIG. 17 is a fragmentary exploded view showing the joint between adjacent strips.
FIG. 18 is an exploded view taken along the lines 18—18 in FIG. 17.
FIG. 19 is an assembled sectional view taken along the lines 19—19 in FIG. 17.
Figure 20:
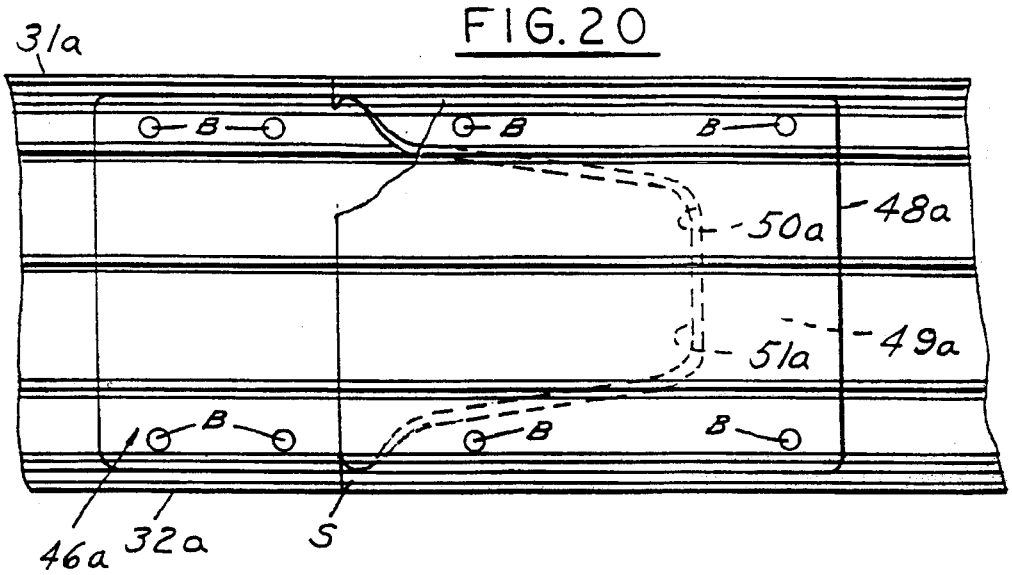
FIG. 20 is a part sectional rear elevational view showing the joint between adjacent flexible strips.
Figure 22:
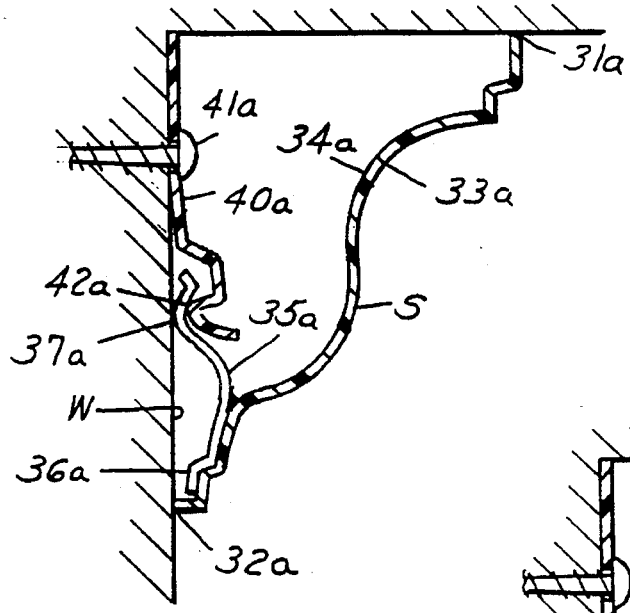
FIG. 22 is a fragmentary sectional view of the decorative strip in assembled relationship to a track, wall and ceiling.
Figure 21:
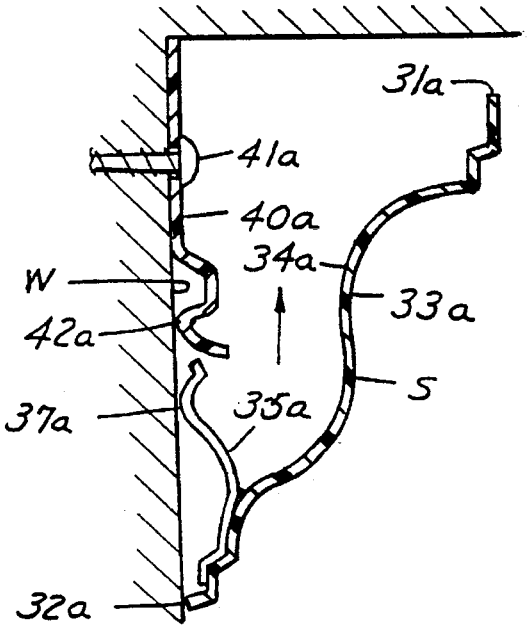
FIG. 21 is a fragmentary sectional view showing the decorative strip of FIGS. 14–20 being assembled on a track in a room.
Figure 23:
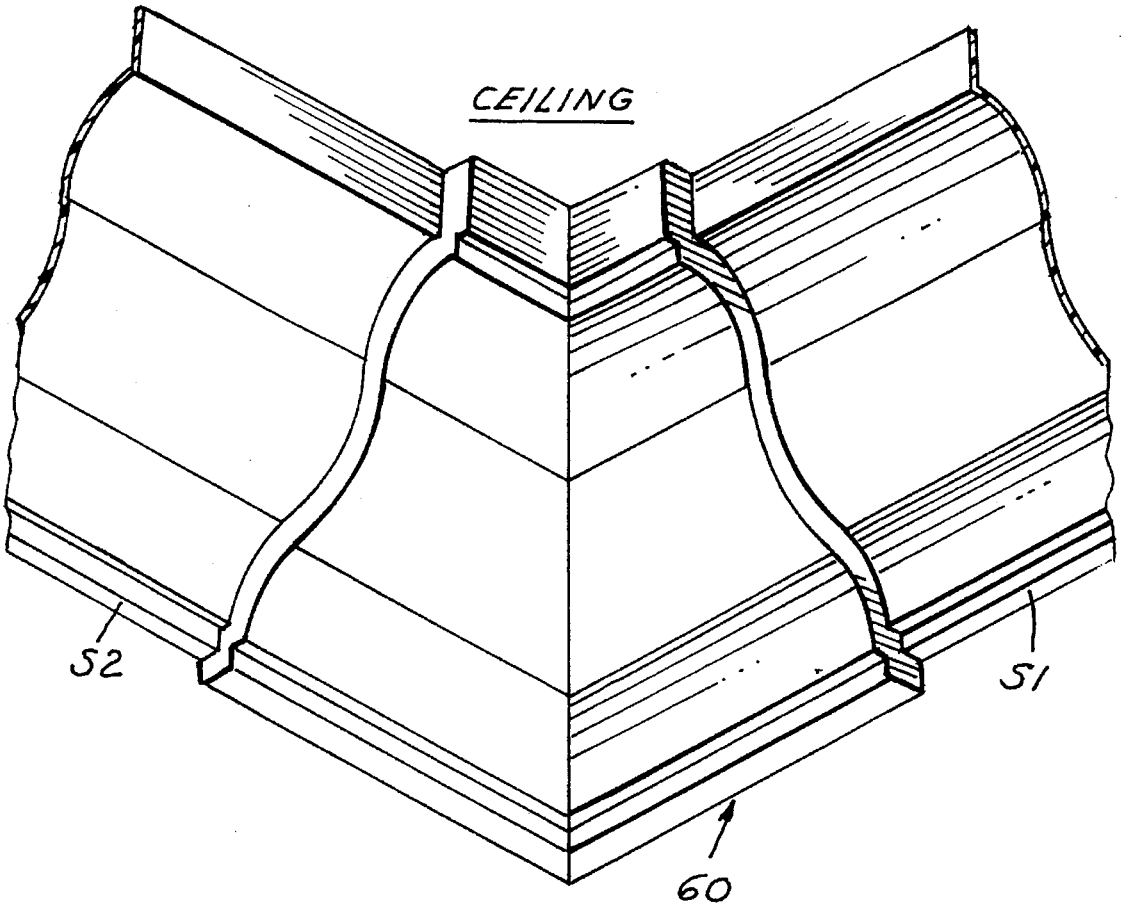
FIG. 23 is a perspective view of an inside corner construction embodying the invention.
Figure 24:
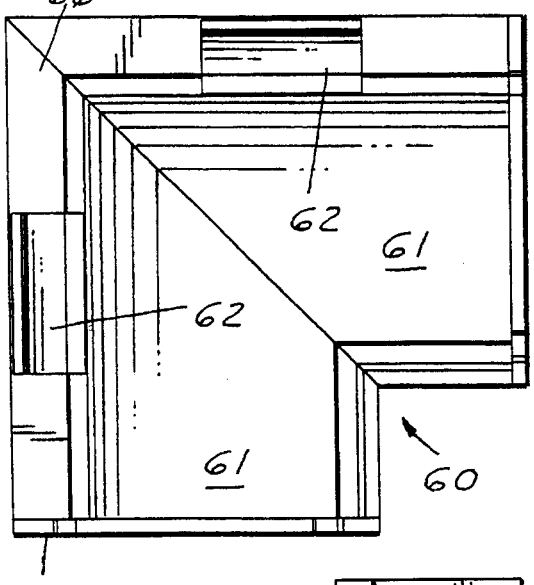
FIG. 24 is a top plan view of the inside corner member shown in FIG. 23.
Figure 28:
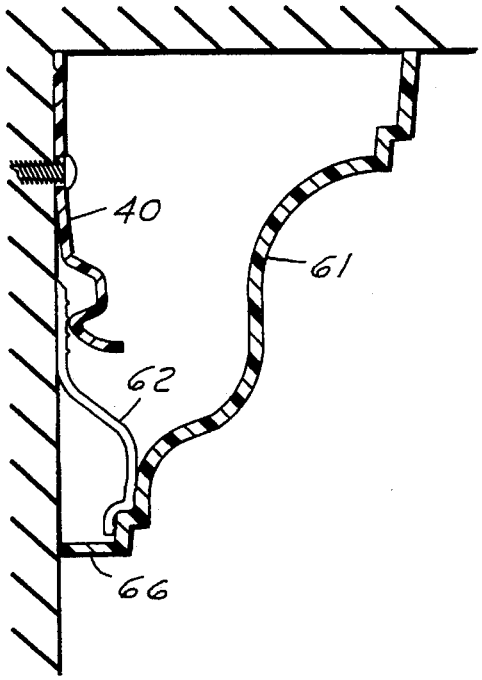
FIG. 28 is a sectional view of the corner member shown in FIG. 23 mounted on a track member at the outside corner of a room.
Figure 25:
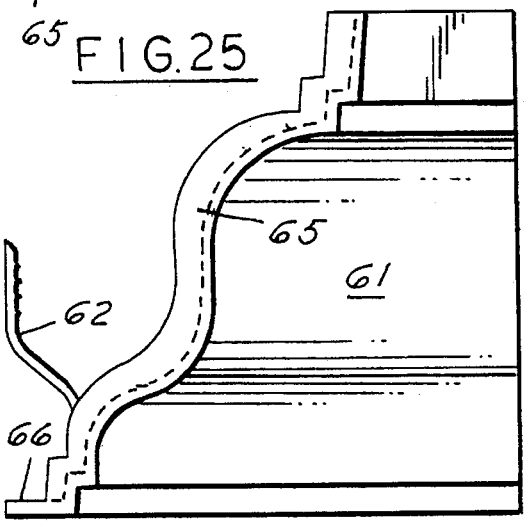
FIG. 25 is a side elevational view taken from the bottom in FIG. 24.
Figure 27:
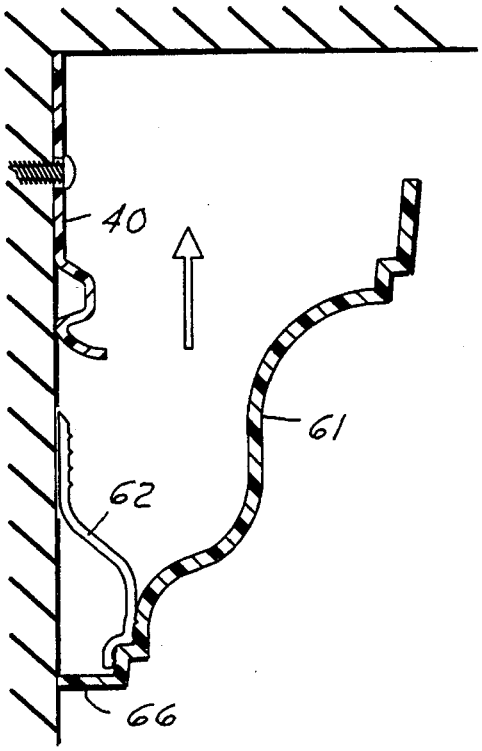
FIG. 27 is a view showing the relative position of the track and corner member during assembly.
Figure 26:
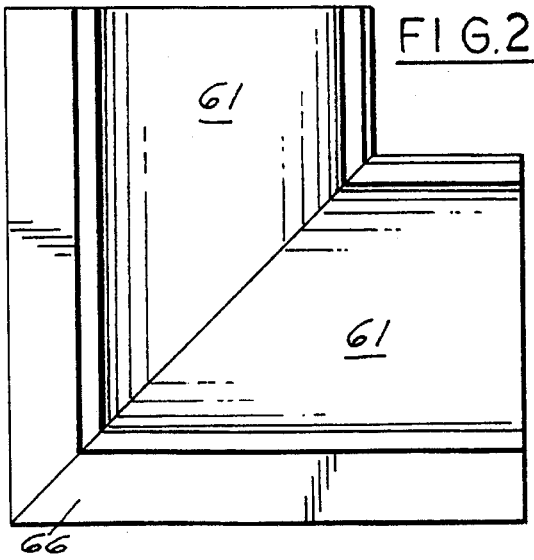
FIG. 26 is a bottom plan view of the inside corner member shown in FIG. 24.
Figure 29:
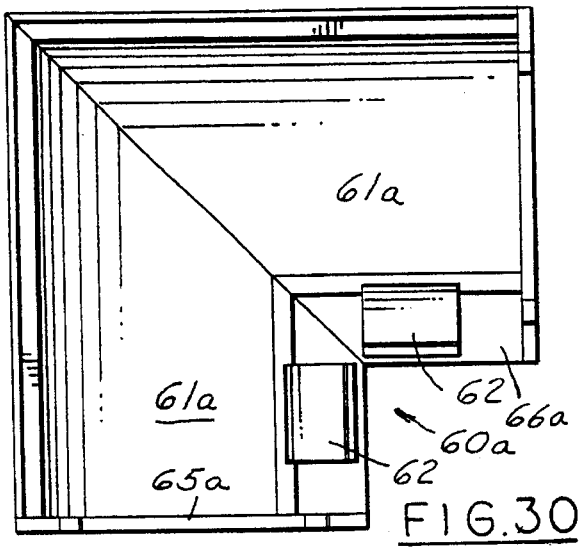
FIG. 29 is a top plan view of an outside corner member.
Figure 30:
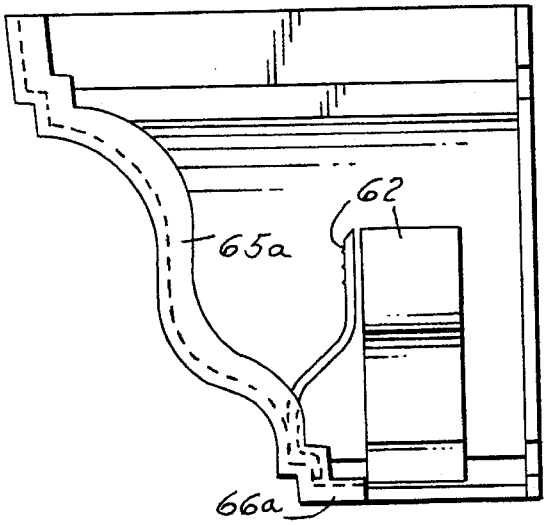
FIG. 30 is a side elevational view of the corner member shown in FIG. 29 taken from the bottom in FIG. 29.
Figure 31:
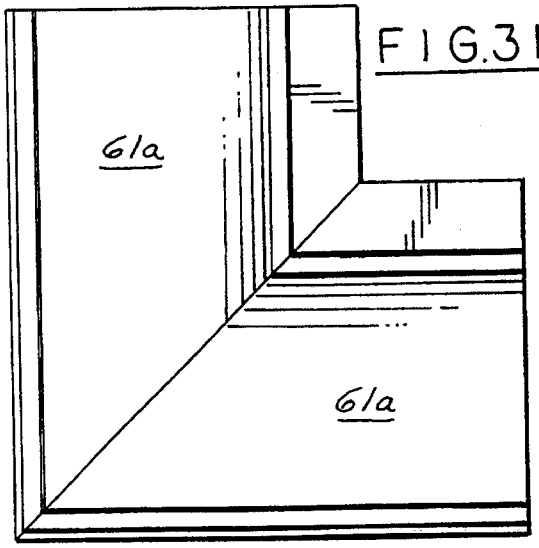
FIG. 31 is a bottom plan view of the corner member shown in FIG. 29.
Figure 33:
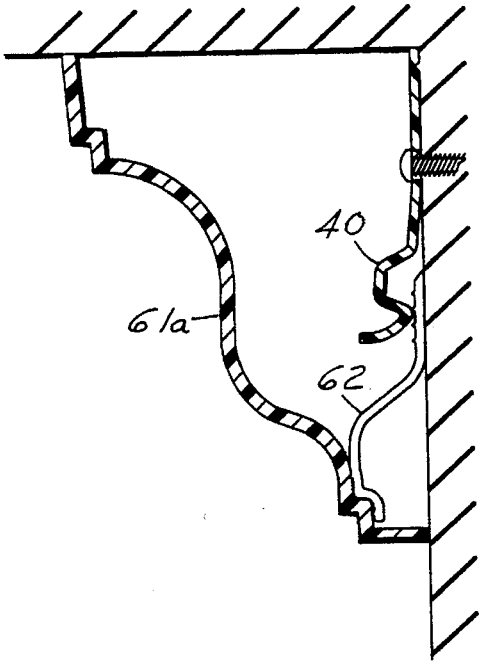
FIG. 33 is a sectional view of the corner member shown in FIG. 29 mounted on a track member at the inside corner of a room.
Figure 32:
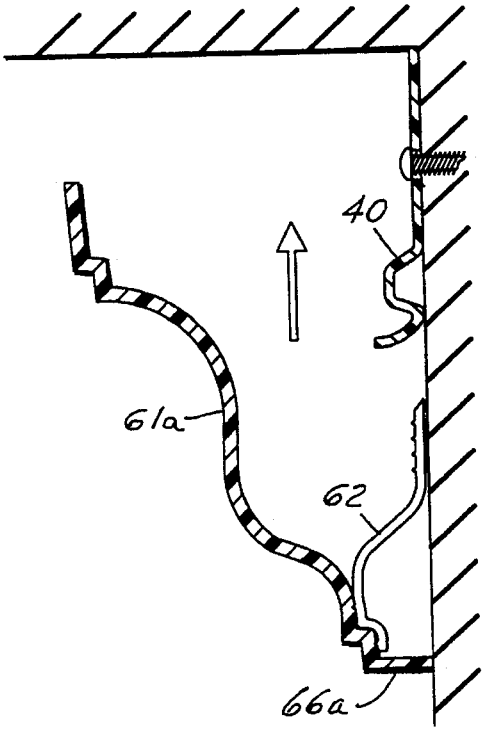
FIG. 32 is a view showing the relative position of the track and corner member shown in FIG. 29 during assembly.

As shown in FIGS. 12 and 13, the strip S has a configuration herein shown as being what is known in the carpentry trade as a dentil shape cove. In such a configuration, "teeth" T are spaced longitudinally adjacent the lower ends of the strip S prime. The thin molding strip has an upper free edge 31, a lower free edge 32, a front surface 33 and rear surface 34. The upper free edge 31 is adapted to lie against either a ceiling or wall and flex relative thereto. The lower free edge 32 is adapted to lie against the other of the ceiling or vertical wall and flex relative thereto. A plurality of flexible clips 35 are fixed at longitudinally spaced point along the strip S at the rear surface adjacent the lower edge 32 as by ultrasonic bonding, heat bonding at or by adhesive. Each clip has a first end 36 fixed to the strip and a second free end 37 (FIGS. 12, 13). The clips 35 are provided at longitudinally spaced points along the strip S. A track 40 is fastened to the wall W as shown in FIG. 12 as by screws 41 and abuts against the ceiling C. The track 40 has an undulating flexible lower edge 42 which is generally complementary to the upper edge 37 of the clips 35 so that by upward movement in the direction of the arrow as shown in FIG. 12 there is interengagement between the track 40 and the clips 35 holding the upper free edge 31 under tension against the ceiling and the lower free edge 32 against the wall W as shown in FIG. 13.

In accordance with the invention, an axially extending cavity 45 is provided at one end of the strip (FIGS. 2 and 3) and an axial projection 46 is provided at the other end of each strip S.

Figure 9:
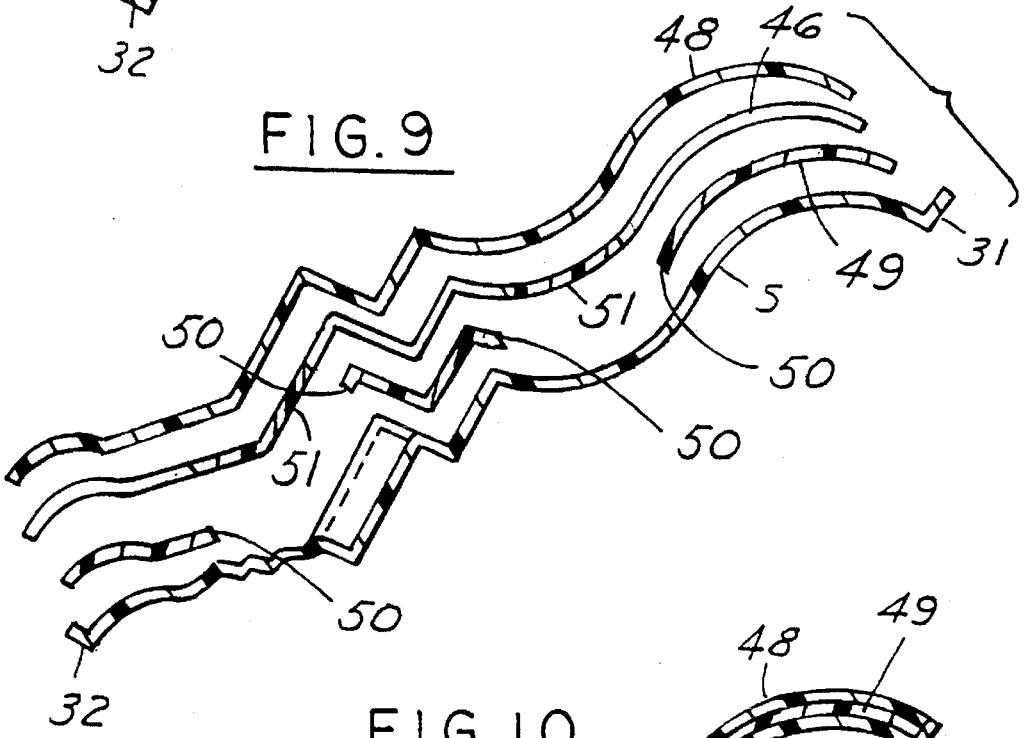
FIG. 9 is an exploded sectional view taken along the line 9—9 in FIG. 5.
Figure 10:
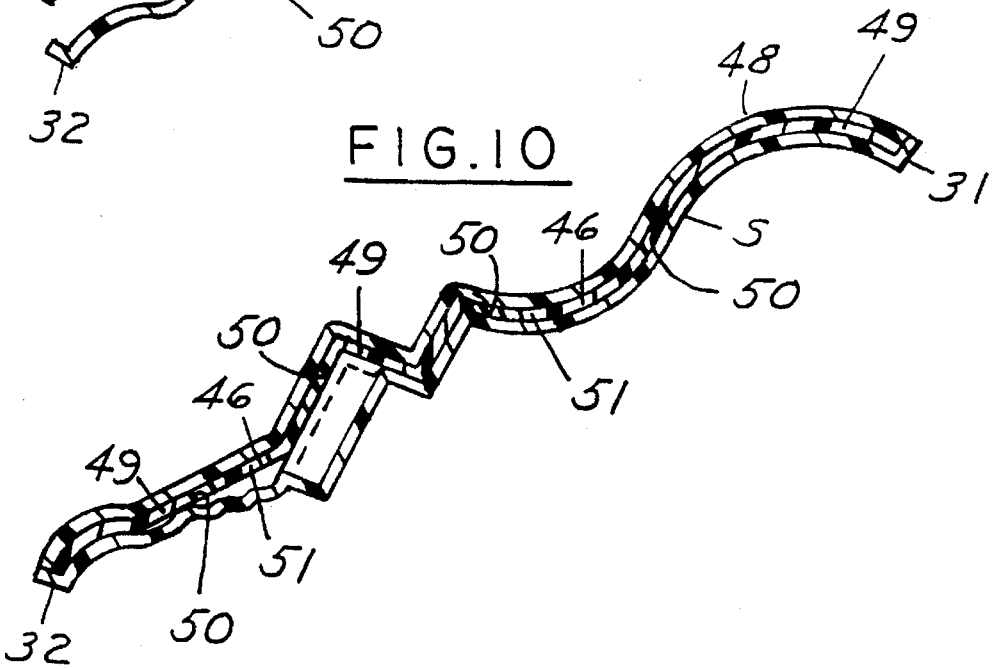
FIG. 10 is an assembled sectional view taken along the line 10—10 in FIG. 5.

Referring to FIGS. 3–7, the cavity 45 is defined by two plastic pieces 48 and 49 which have a general cross-sectional configuration of the strip S as shown in cross section in FIG. 9 which is an exploded view. The piece 49 function as a spacer which includes two axial slots 50 such that when it is provided on the inside surface of the strip S it defines the cavity 45 in cooperation with the strip S.

Figure 5:
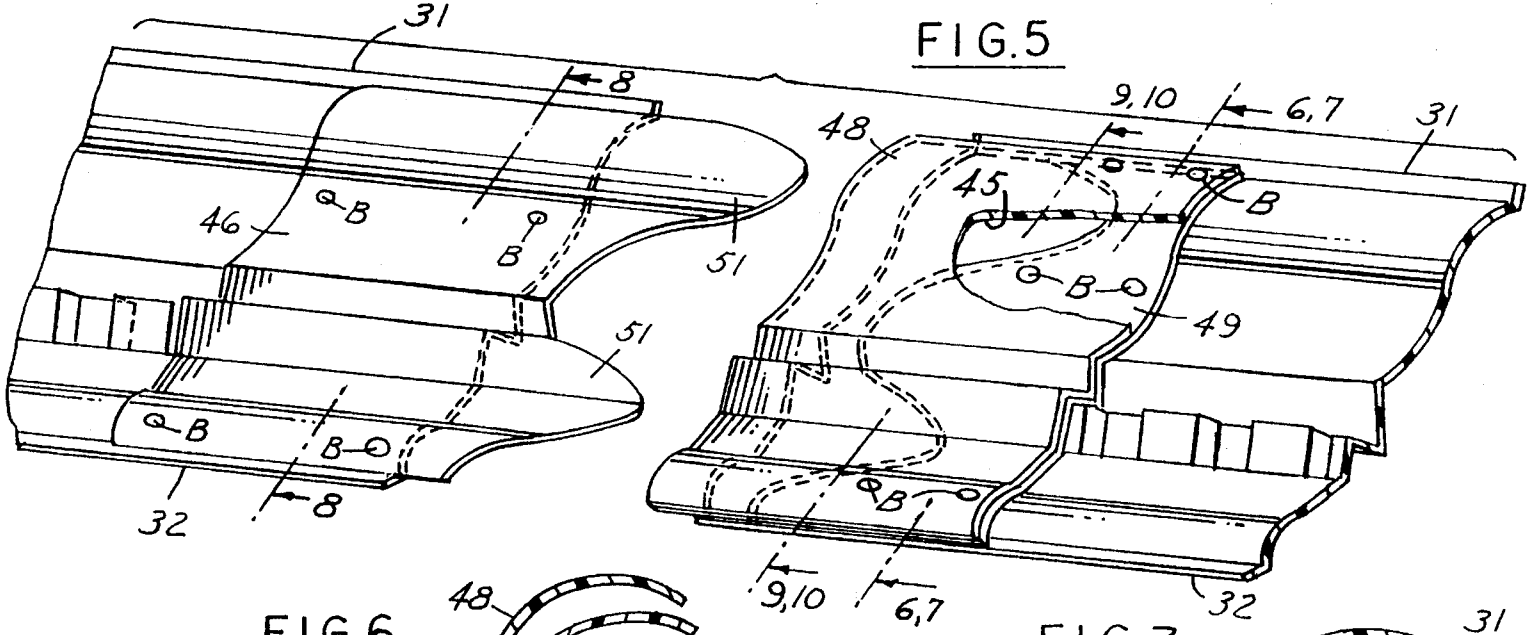
FIG. 5 is a rear exploded perspective view of a joint between adjacent strips.
Figure 7:
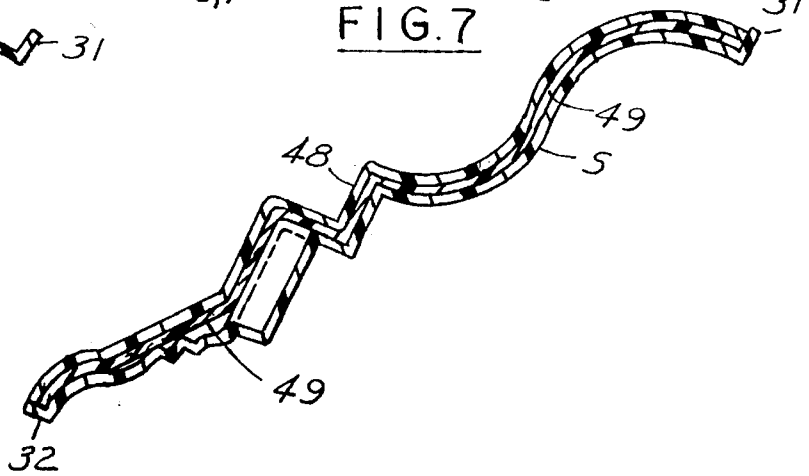
FIG. 7 is a sectional view taken along the lines 7—7 in FIG. 5.
Figure 6:
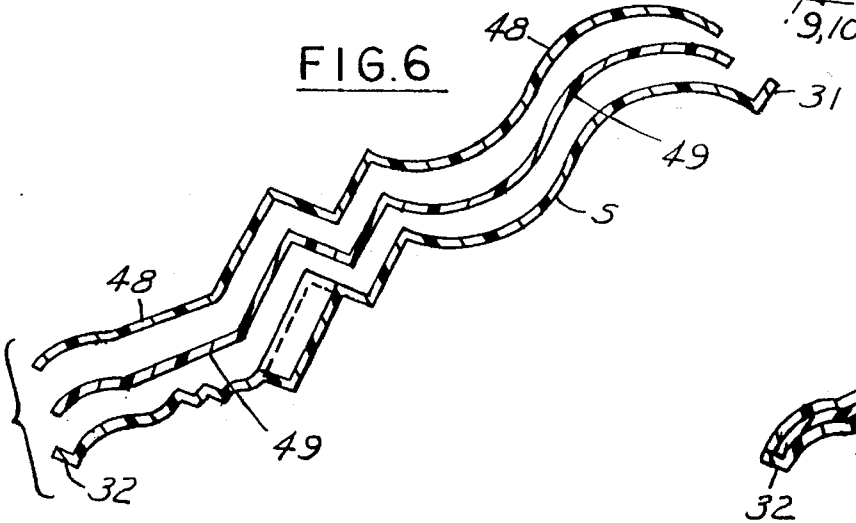
FIG. 6 is a sectional exploded view taken along the lines 6—6 in FIG. 5.
Figure 8:
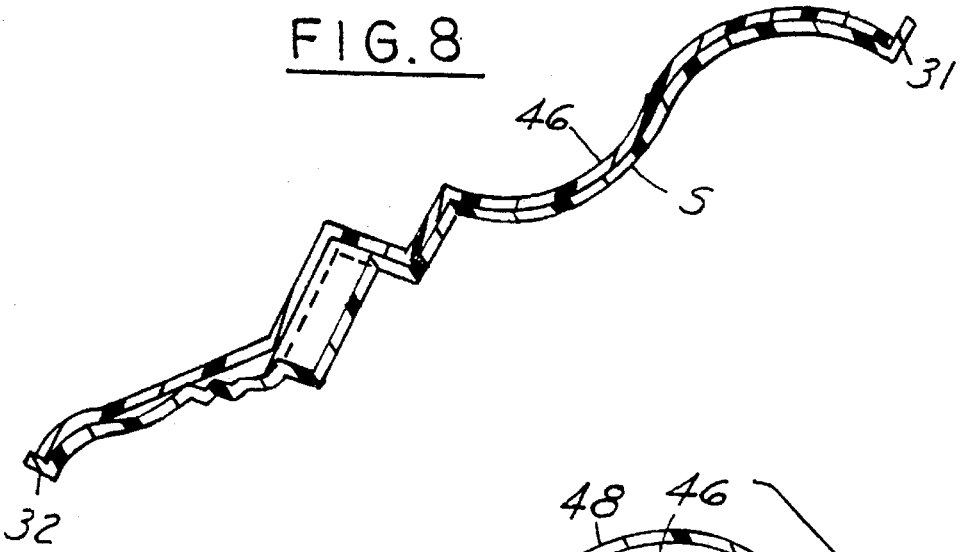
FIG. 8 is a sectional view taken along the line 8—8 in FIG. 5.

The axial projection 46 also has the complementary configuration to the inner surface of the strip S and has spaced tips 51 complementary to the piece 49 (FIG. 5). The axial projection 46 is fixed as by ultrasonic welding at B, heat bonding or adhesive to the interior surface of the strip S. Similarly, the pieces 48 and 49 are bonded to the strip S by ultrasonic welding, heat bonding and adhesive.

Figure 11:
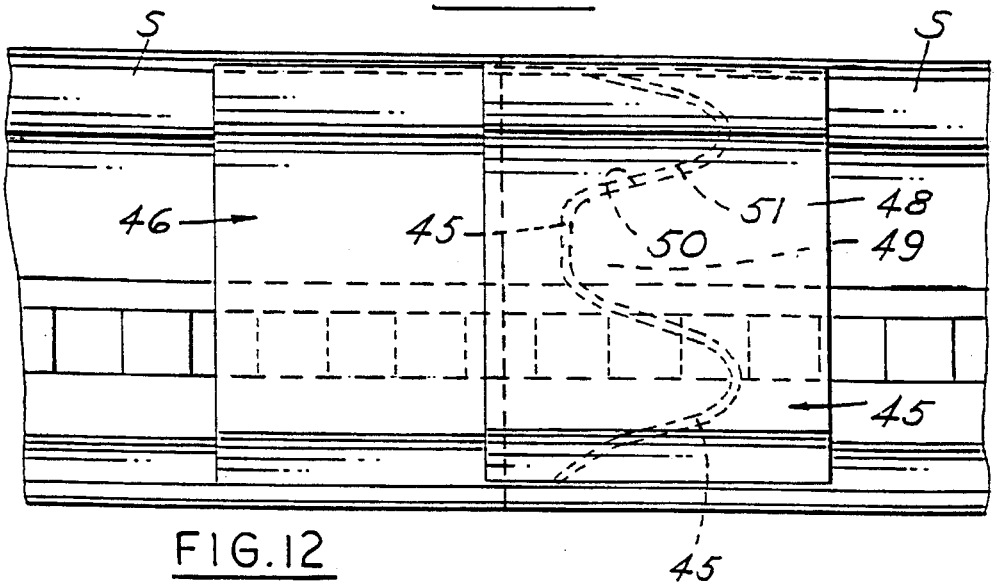
FIG. 11 is a part sectional rear elevational view showing the joint between strips.

When one strip is assembled with respect to the other, the joint is provided as shown in FIG. 11 which is a rear view assembly of the joint. In accordance with the invention, the space between teeth is such that at each end one-half space is provided whereby when a joint is created by bringing adjacent strips into engagement, the appearance of a equally spacing of teeth is provided between adjacent strips.

In the modified form shown in FIGS. 14–22, the structure is substantially the same except at the configuration of the strips as prime are what is known as ogee shaped in the carpentry trade or a cove.

Otherwise, the construction is substantially the same as shown in FIGS. 1–13, corresponding parts being provided with a suffix "a".

In accordance with the invention, the decorative molding system is of the type described in the aforementioned patent applications.

In accordance with the present invention the system as shown in FIGS. 23–28 at an inside corner includes a molded plastic corner member 60. The corner member 60 comprises a one-piece plastic body having integral walls 61 configured to contact the front surfaces of the decorative molding strips S1 that extend to the corner of the room herein shown as being an ogee configuration. Each wall 61 has a flexible plastic clip 62 fixed to the back surface of the wall 61 of the corner member 60. Alternatively, the clip can be injection molded at the same time as the corner member. The flexible wall tracks 40 that extend toward the corner of the room and the flexible clips 62 on the walls 61 of the corner member 60 have free ends that engage the tracks 40. The corner member 60 preferably includes free edges in the form of flanges 64 that extend inwardly from the wall 61 of the corner member 60 and have a configuration conforming with the exterior of the respective molding strip S1. The corner member 60 includes upper and lower edges in the form of flanges 65, 66 that extend vertically and horizontally. Corner member 60 is preferably injection molded and the clips 62 are ultrasonic bonded to the inner surface of walls 61. Preferably the walls and flanges are uniformly thin on the order of 0.090–0.100 inch. A preferred plastic material is polystyrene for the corner members and clips.

Figure 35:
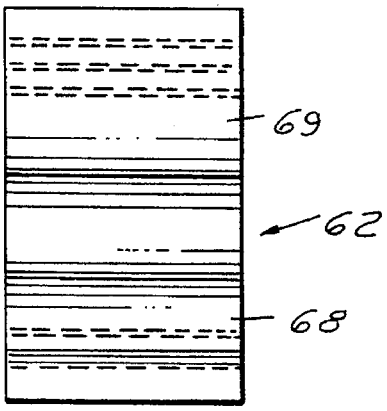
FIG. 35 is a side elevational view taken from the left in FIG. 34.
Figure 34:
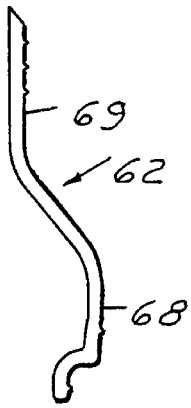
FIG. 34 is a side view of the clip utilized in connection with the corner members shown in FIGS. 23–33.
Figure 36:
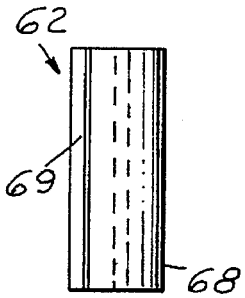
FIG. 36 is a top view of the clip shown in FIG. 34.

Each clip 62 preferably has a configuration such as shown in FIGS. 34–36 and comprises plastic body 67 which is cut from an extruded strip. Each clip 62 includes a curved portion 68 for engaging the inner surface of each wall 61 to which the clip 67 is attached by ultrasonic welding. The other end 69 of each clip 67 is flat and provided with spaced transverse ribs 69 that extend the full width of the clip and frictionally engage the arcuate rib on the wall track 40 and thereby accommodate minor dimensional differences in contact caused by variations in the wall or ceiling.

For use in an outside corner, as shown in FIGS. 42–46 each corner member **60*c*** is similarly constructed, corresponding parts being designated with the suffix "c".

Figure 48:
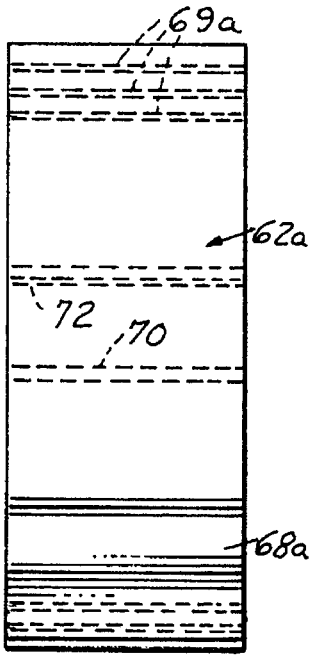
FIG. 48 is a view taken from the left in FIG. 47.
Figure 47:
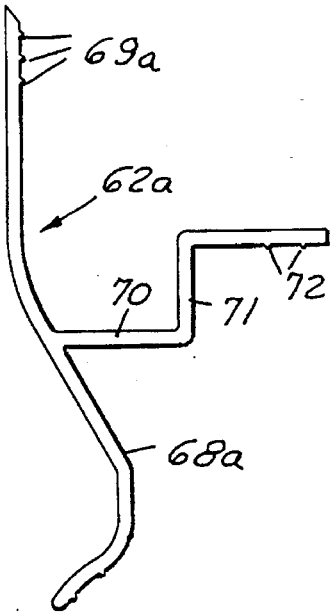
FIG. 47 is a side elevational view of a clip utilized on the corner members shown in FIGS. 37–46.
Figure 49:
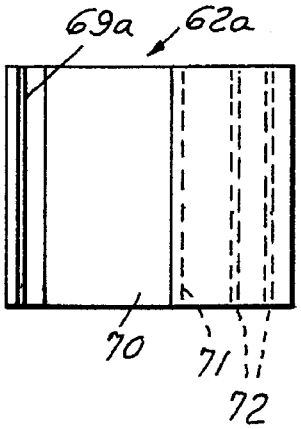
FIG. 49 is a top plan view of the clip shown in FIG. 47.
Figure 37A:
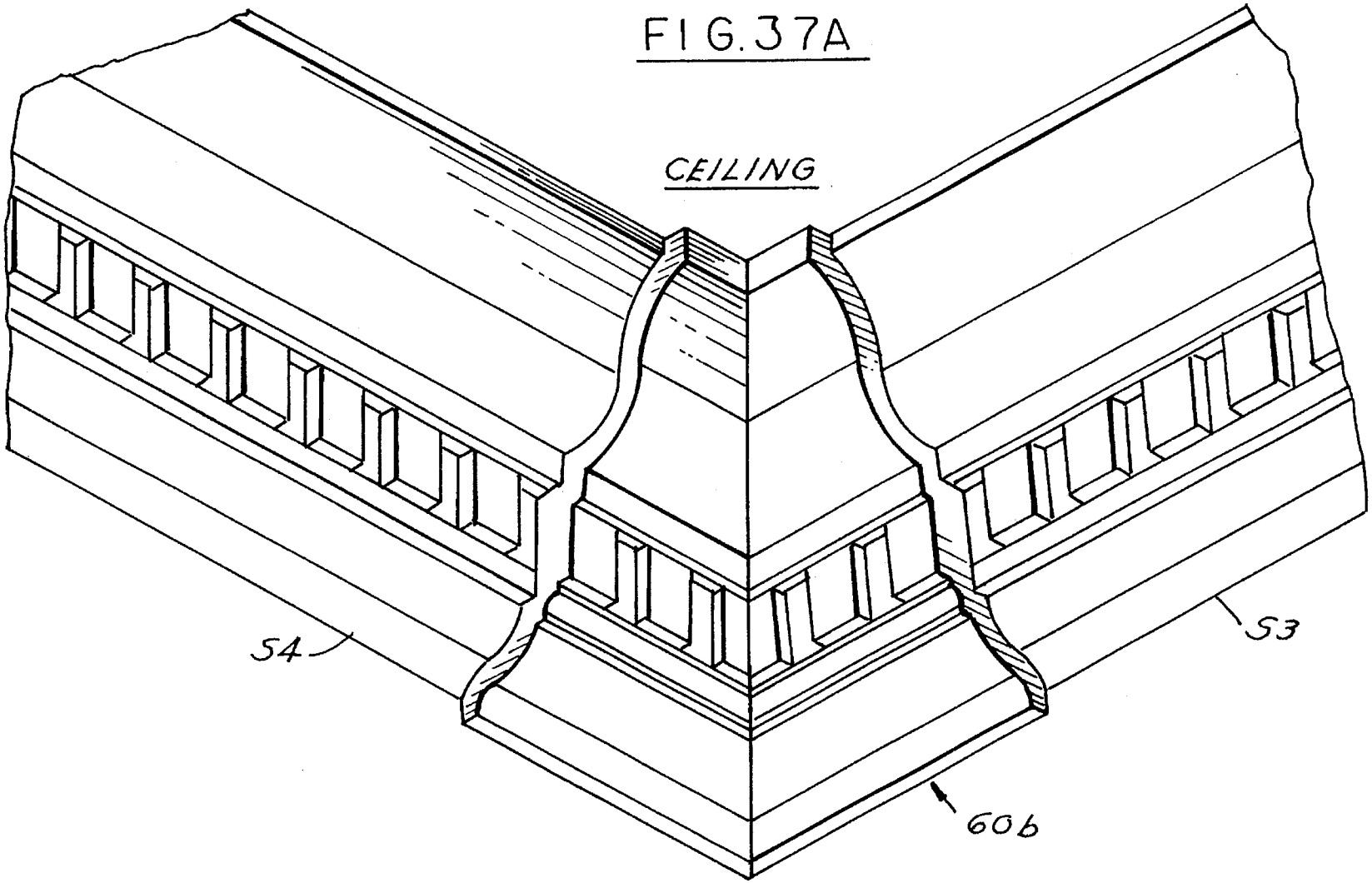
FIG. 37A is a perspective view of an inside corner system.
Figure 37:
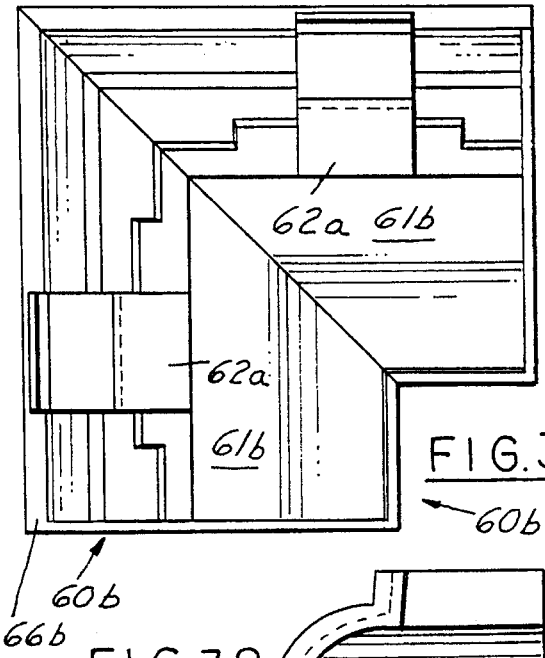
FIG. 37 is a top plan view of an inside corner member for a dentil type molding.
Figure 38:
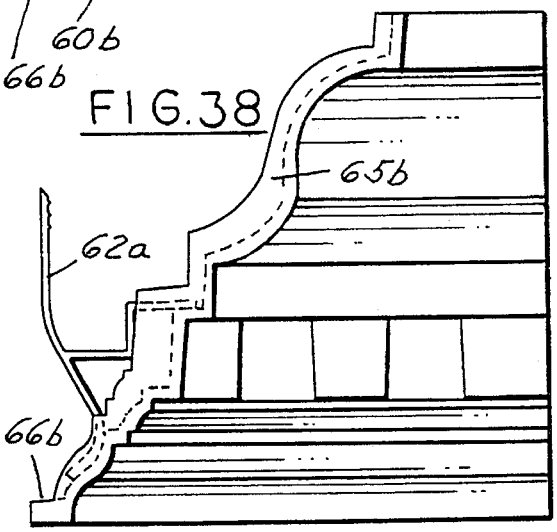
FIG. 38 is a side view of the corner member shown in FIG. 37 taken from the bottom of FIG. 37.
Figure 39:
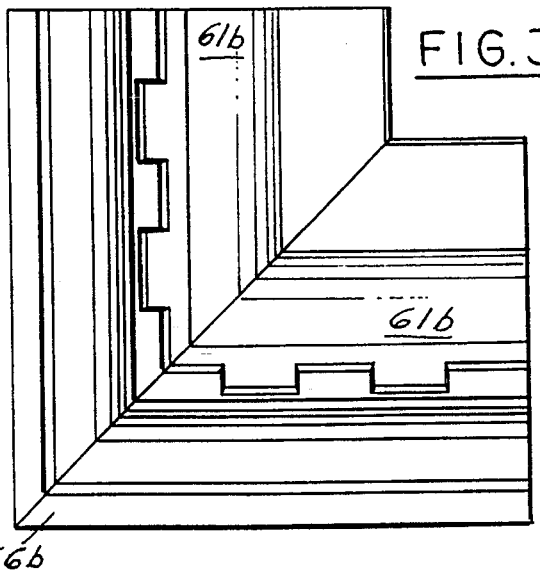
FIG. 39 is a bottom view of the corner member shown in FIG. 38.
Figure 41:
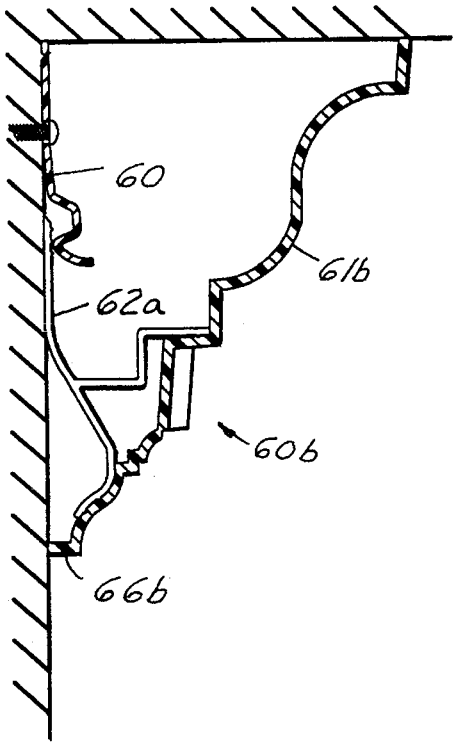
FIG. 41 is a sectional view showing the corner member in assembled position.
Figure 40:
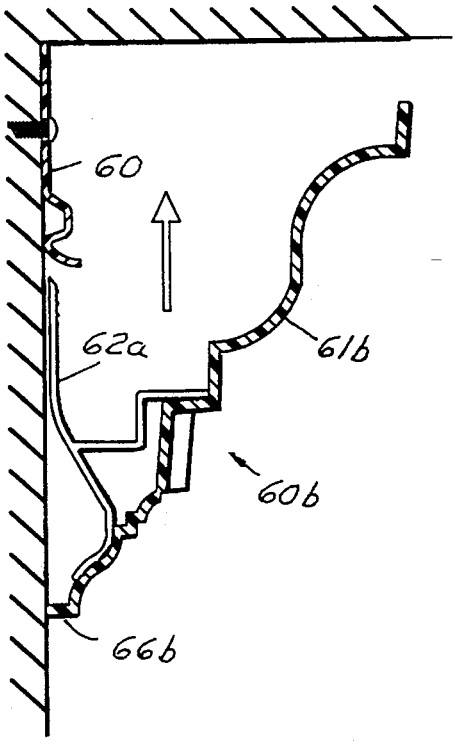
FIG. 40 is a sectional view showing the corner member during assembly on tracks.

The invention is also applicable to thin flexible strips systems wherein rather than having a dentil configuration as shown in FIGS. 37–46. In this form, the clips are modified as shown in FIGS. 47–49 to accommodate the configuration of the corner members with the molding strips.

As is well known, the configuration of a dentil molding includes a strip having a plurality of longitudinally spaced teeth. In the form shown in FIGS. 37–41, which relate to an inside corner, the corner member **60*b* includes walls 61*b* having a complementary configuration to the dentil molding strips and a clip 62*b* as shown in FIGS. 47–49 is provided. The clip 62*b* includes a curved portion 68*a* that is attached to each wall of the corner member by ultrasonic welding. The other end of the clip is flat and provided with spaced transverse ribs 69*a*. In this form, the clip 62*b* includes a flange 70 intermediate the ends that has a stepped portion 71 with ribs 72 engaging the step in each wall 61*b*** and ultrasonically welded to the corner member.

For an outside corner of the dentil molding, corner construction **60*c* is provided and is otherwise similarly constructed, corresponding parts being designated by the suffix "c", as shown in FIGS. 42–46**.

The preferred method of installing the decorative molding system embodying the invention is as follows:

1. Provide a mark indicating a space from each inside corner of the room at about ½ inch from the intersection at the corner.

2. Install the track starting from the mark at the inside corner with the upper edge of the track flush against the ceiling.

3. In order to cut a hanger strip, it is only essential to provide a score perpendicular to the line with a utility knife and then bend the strip to snap it apart. Alternative track can be cut with scissors.

4. A screw should be provided adjacent the free end of the track at a corner.

5. Where outside corners are provided the track should be provided flushed to the corner on both sides of the corner.

6. Each of the corner members is installed. The molding strips S are then installed in succession, first cutting off the male joint on the first male piece of molding with scissors.

7. Each successive piece is installed by inserting the male joint into the female joint and continuing to insert the strip by sliding it successively into the tracks.

8. As a corner is reached, the corner member is removed and the piece of molding is inserted and then the corner member is installed back in place.

9. If there are severe irregularities, the track can be cut along a scored line to ensure a tighter fit.

10. Where a dentil molding is used, the corner may interfere with the raised dentil tooth of the molding. In this case the side of the tooth needs to be cut to provide an even fit. This is facilitated by cutting along the stepped line on the inside tooth profile.

11. After the entire room is pre-installed, the molding strips and corners may be removed for finishing. Each of the pieces should be provided with indicia preferably in sequenced along the back side so that they can be reinstalled in the proper order.

12. For staining, the stain is applied and while parts are joined as between molding strips and corner member, the staining should be done in order to provide a uniform look between the parts.

13. If it is desired to paint, a prime coating and a finish coating are used.

In the event that a wall or ceiling is at a different angle due to extreme variations, the flanges 65, 66 can be sanded or cut to provide a conforming contact. This is shown diagramtically in FIGS. 50–57.

Figure 50:
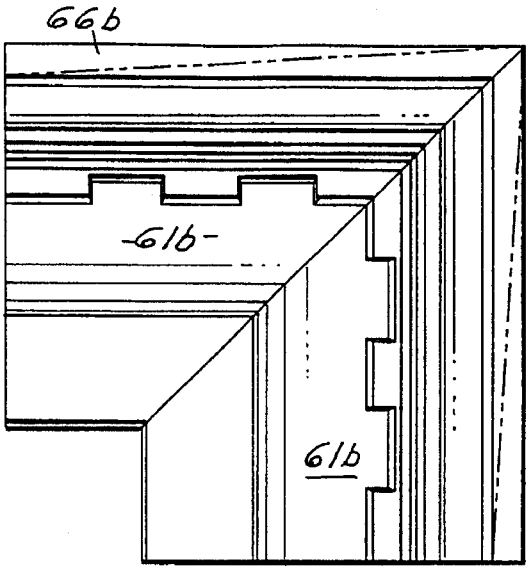
FIGS. 50–53 are views showing the manner of trimming the corner member to accommodate wide variations in angles between the walls.
Figure 51:
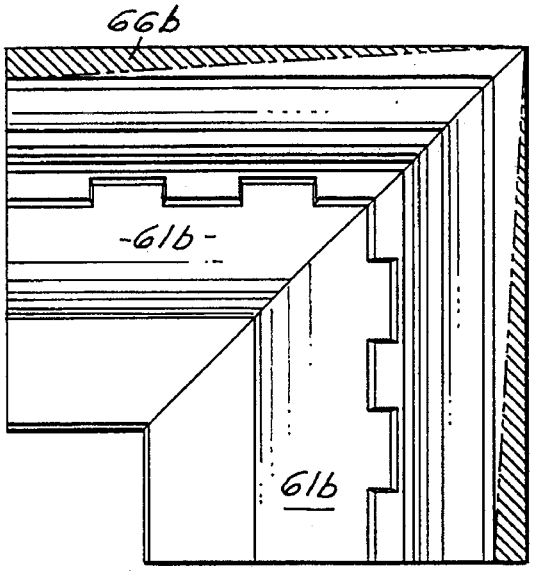
Figure 52:
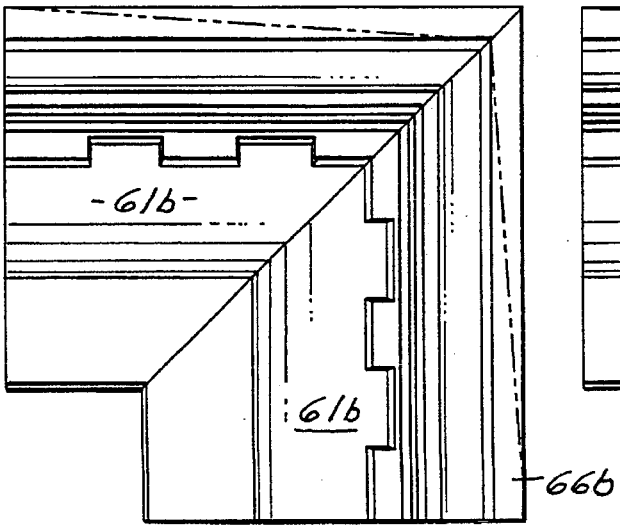
Figure 53:
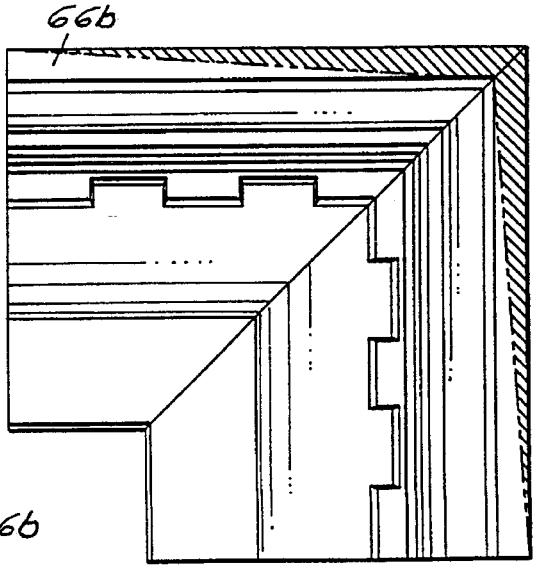
Figure 55:
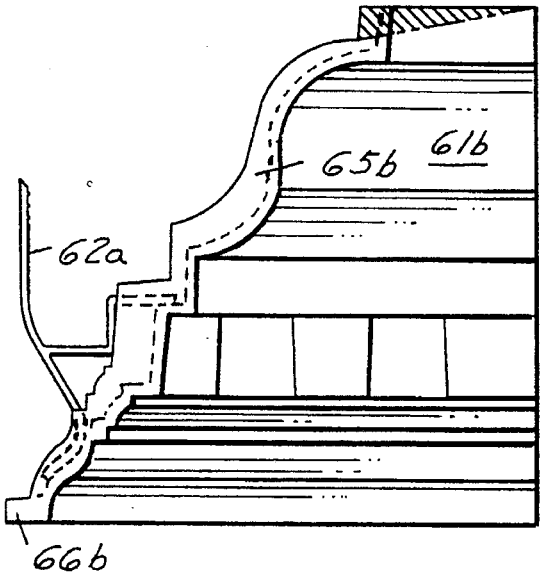
FIGS. 54–57 show the manner of trimming to accommodate wide variations in the ceiling.
Figure 57:
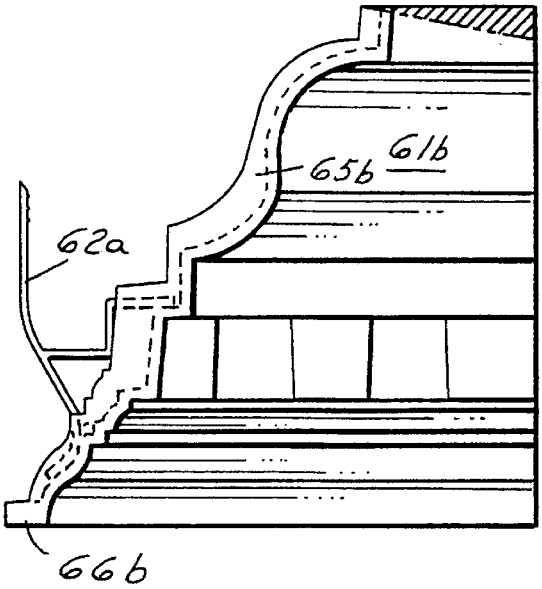
Figure 54:
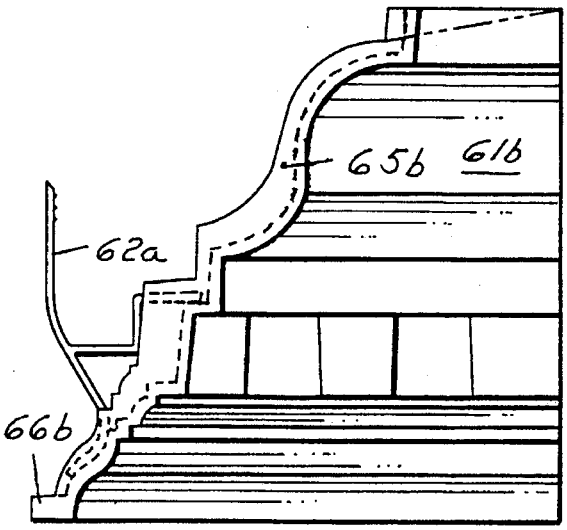
Figure 56:
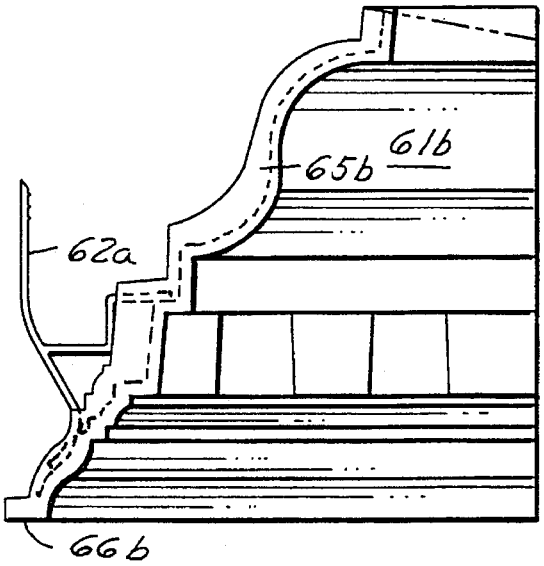

As shown in FIGS. 50 and 51, the walls at the corner meet to form an acute angle of less than 90°. In this event the flanges can be cut by sanding as shown in the cross section. Referring to FIGS. 52 and 53, when the walls form an angle greater than 90°, the flanges can be cut by sanding as shown in the cross section. Similarly, if the ceiling is not in the same plane and at a right angle to the walls, the flanges can be cut by sanding as shown in cross section in FIGS. 54 and 55 or FIGS. 56 and 57.

It can thus be seen that there has been provided a decorative molding strip system which utilizes novel outside and inside corner constructions; wherein the corners can be readily applied with minimum tools and skills; wherein the resultant system is aesthetically pleasing; wherein the corner construction will accommodate variations in the angle of the walls and the ceilings to one another; and wherein the system is low in cost.

What is claimed is:

1. A decorative molding system removably installed at a juncture of a ceiling and a vertical wall, said molding system comprising:

a plurality of thin molding strips of flexible plastic having a length and an upper free edge, a lower free edge, a front surface and a back surface, said upper free edge being adapted to lie against one of said ceiling and said vertical wall along a line spaced from the juncture of the ceiling and vertical wall and flex relative thereto, said lower free edge being adapted to lie against the other of said ceiling and said vertical wall along a line spaced from the juncture of the ceiling and vertical wall and flex relative thereto, a plurality of flexible plastic clips, each said flexible plastic clip having a first end and a second free end, said flexible plastic clips being attached at spaced points along the length of the back surface of each molding strip such that the first end of each said clip is attached on the back surface of said molding strip at a point of attachment intermediate the upper free edge and lower free edge of said molding strip and said second free end of each said clip extends at an angle from said point of attachment, said second free end of each said clip being capable of flexing relative to said point of attachment to said molding, each said molding strip being sufficiently flexible about its length as well as its width to provide conforming engagement of its upper free edge and its lower free edge with the ceiling and vertical wall to provide conforming engagement with the ceiling and vertical wall, a plurality of wall tracks of thin flexible plastic having a back surface, a front surface, an upper edge and a forward leading edge providing a gap between the leading edge and the front surface, means for mounting the upper edge of each track on one of said ceiling and said vertical wall adjacent the juncture of said ceiling and said vertical wall such that said forward leading edge is spaced from the other of said ceiling and said vertical wall, said forward leading edge of said track being capable of flexing relative to said upper edge of said track, interengaging means on said second free end of said clip and said forward leading edge of said track such that when the thin molding strip with the flexible plastic clips attached thereto is mounted on said track by movement of each said second free end if each said clip into the gap between the leading edge of said track and the front surface, the second free end of each said clip is moved into the gap and said forward leading edge of said track are interengaged, such that each said thin molding strip is restrained against ready removal and such that when said molding strip is mounted on said wall track, the upper edge of said molding strip is angled outwardly from said track, such that said clip is positioned between said lower forward free edge of said wall track and its associated wall, at least one pair of said plastic molding strips having free ends with their longitudinal axis forming an angle at a corner of a room, a plastic corner member provided between said adjacent plastic molding strips and forming a corner, said plastic corner member comprising a one piece plastic body having side walls intersecting at substantially the same angle as the angle formed by the axis of adjacent plastic molding strips, each said side wall having substantially the same undulating cross sectional configuration as the first surfaces of said adjacent plastic molding strips, each said wall having an upper free edge, a lower free edge and a vertical free edge, an outer surface and an inner surface, a flexible plastic clip means attached to each said side wall, each said clip means having said first end and a second free end, said first end being attached to the inner surfaces of its respective side wall intermediate the upper free edge of said wall and the lower free edge of said wall and said second free end of said clip extending at an acute angle to said wall of said corner member from said point of attachment, said free end of each said clip on said wall having interengaging means engaging said interengaging means on said forwarding leading edge of said track and holding said corner member in contact with said adjacent molding strips.

2. The decorative molding system set forth in claim 1 wherein said clip means comprises a one piece plastic body sonic bonded to each said wall.

3. The decorative molding system set forth in claim 2 wherein each said clip means includes a generally flat free end frictionally engaging said forward free edge of its respective track.

4. The decorative molding system set forth in claim 3 including spaced ribs on said free end of said clip means engaging the forward free edge of said track.

5. The decorative molding system set forth in any one of claims 1–4 wherein said free edges of each said wall of said corner member comprise integral flanges extending rearwardly.

6. A decorative molding system removably installed at a juncture of a ceiling and a vertical wall, said molding system comprising a pair of adjacent flexible thin molding strips, each said thin molding strip having a length and an upper free edge, a lower free edge, a undulating front surface and a undulating back surface, said upper free edge being adapted to lie against one of said ceiling and said vertical wall along a line spaced from the juncture of the ceiling and vertical wall and flex relative thereto, said lower free edge being adapted to lie against the other of said ceiling and said vertical wall along a line spaced from the juncture of the ceiling and vertical wall and flex relative thereto, a plurality of flexible plastic clips, each said flexible plastic clip having a first end and a second free end, said flexible plastic clips being attached at spaced points along the length of the undulating back surface of each molding strip such that the first end of each said clip is attached on the back surface of said molding strip at a point of attachment intermediate the upper free edge and lower free edge of said molding strip and said second free end of each said clip extends at an angle from said point of attachment, said second free end of each said clip being capable of flexing relative to said point of attachment to said molding, each said molding strip being sufficiently flexible about its length as well as its width to provide conforming engagement of its upper free edge and its lower free edge with the ceiling and vertical wall to provide conforming engagement with the ceiling and vertical wall, a pair of wall tracks of thin flexible plastic having a back surface, a front surface, an upper edge and a forward leading edge providing a gap between the leading edge and the front surface, means for mounting the upper edge of each track on one of said ceiling and said vertical wall adjacent the juncture of said ceiling and said vertical wall such that said forward leading edge is spaced from the other of said ceiling and said vertical wall, said forward leading edge of said track being capable of flexing relative to said upper edge of said track, interengaging means on said second free end of said clip and said forward leading edge of said track such that when the thin molding strip with the flexible plastic clips attached thereto is mounted on said track by movement of each said second free end if each said clip into the gap between the leading edge of said track and the front surface, the second free end of each said clip is moved into the gap and said forward leading edge of said track are interengaged, such that each said thin molding strip is restrained against ready removal and such that when said molding strip is mounted on said wall track, the upper edge of said molding strip is angled outwardly from said track, such that said clip is positioned between said lower forward free edge of said wall track and its associated wall, a plastic corner member between said adjacent plastic molding strips to form a corner at the juncture of a ceiling and a wall, said plastic corner member comprising a one piece plastic body having side walls intersecting at substantially the same angle as the angle formed by a corner of a room in which the corner member is to be used, each said side wall having an undulating cross sectional configuration for engaging said undulating front surface of a respective thin plastic molding strip, each said side wall having an upper free edge, a lower free edge and a vertical free edge, an outer surface and an inner surface, said free edges of each said side wall wall of said corner member comprising integral flanges extending rearwardly and adapted to engage a respective thin flexible molding strip, a flexible plastic clip means attached to each said side wall, each said clip means having a first end and a second free end, said first end being attached to the inner surface of a respective side wall of said corner member intermediate the upper free edge of said side wall and the lower free edge of said side wall and said second free end of said clip means extending at an acute angle to said side wall of said corner member from a point of attachment, said free end of each said clip means on said side wall having interengaging means thereon for engaging a respective track and holding said corner member in contact with adjacent molding strips at the corner of a room.

7. The decorative molding system set forth in claim 6 wherein said clip means comprises a one piece plastic body bonded to each said wall.

8. The decorative molding system set forth in claim 7 wherein each said clip means includes a generally flat free end adapted to frictionally engage said forward leading edge of a respective track.

9. The decorative molding system set forth in claim 8 including spaced ribs on said free end of said clip means adapted to engage said forward leading edge of a track.

* * * * *